US005899424A

United States Patent [19]

Williams, Jr.

[11] Patent Number: 5,899,424

[45] Date of Patent: May 4, 1999

[54] RETRACTABLE BRACKET FOR MOUNTING MINI-BLINDS AND THE LIKE TO A WINDOW

[75] Inventor: Royall E. Williams, Jr., Chapel Hill, N.C.

[73] Assignee: Royall Enterprises, Inc., Chapel Hill, N.C.

[21] Appl. No.: 08/799,775

[22] Filed: Feb. 12, 1997

[51] Int. Cl.[6] ..... A47H 1/10

[52] U.S. Cl. ..... 248/267; 248/262

[58] Field of Search ..... 248/200, 247, 248/201, 257, 258, 265, 269, 271, 281, 267, 27.1

[56] References Cited

U.S. PATENT DOCUMENTS

| | | | |
|---|---|---|---|
| 675,220 | 5/1901 | Jones | 248/269 |
| 705,339 | 7/1902 | Giorgio | 248/269 |
| 838,181 | 12/1906 | Grippin | 248/269 |
| 1,341,742 | 6/1920 | Fisher . | |
| 1,499,340 | 7/1924 | Bundy, Jr. | 248/269 |
| 1,606,986 | 11/1926 | Clark | 248/268 |
| 2,013,500 | 9/1935 | O'Connor | 248/269 |
| 2,332,851 | 10/1943 | Harris | 160/34 |
| 2,341,217 | 2/1944 | Holtzclaw | 248/265 |
| 2,894,710 | 7/1959 | Shields | 248/265 |
| 3,730,469 | 5/1973 | Shields | 248/258 |

*Primary Examiner*—Leslie A. Braun
*Assistant Examiner*—Gwendolyn Wrenn
*Attorney, Agent, or Firm*—Jenkins & Wilson, P.A.

[57] ABSTRACT

A retractable bracket for mounting one end of a window shade, venetian blind or mini-blind to the head jamb of a window. The retractable bracket is mounted in an aperture within the window head jamb so as to be substantially flush therewith when in an inoperative mode. The retractable bracket includes a bracket arm that can be adjusted by means of an actuator screw so as to be urged from a first inoperative retracted position to a outwardly and downwardly extended operative position. The bracket arm includes a plurality of spaced-apart apertures therein to which a bracket for a window shade, venetian blind or mini-blind may be selectively secured when the bracket arm is in its extended position. If the window shade, venetian blind or mini-blind is removed, the actuator screw can be rotated in an opposite direction in order to retract the bracket arm upwardly and inwardly into the retractable bracket so that the retractable bracket is again substantially flush with the window head jamb.

11 Claims, 4 Drawing Sheets

RETRACTABLE BRACKET FOR MOUNTING MINI-BLINDS AND THE LIKE TO A WINDOW

TECHNICAL FIELD

The present invention relates to brackets for mounting mini-blinds, shades and the like to a window. More particularly, the present invention relates to a device adapted to be mounted within the head jamb of a window and to provide a retractable bracket for mounting mini-blinds, shades and the like to a window.

RELATED ART

The prior art is replete with brackets and other devices for mounting shades, blinds and mini-blinds to a window. However, all efforts known to applicant to date tend to be time-consuming and many times to provide a less than aesthetic appearance once the shades, blinds or mini-blinds are mounted to a window. Representative prior art patents directed to brackets for mounting window shades and venetian blinds include U.S. Pat. No. 1,499,340 to Bundy, Jr.; U.S. Pat. No. 2,332,851 to Harris.

All of the prior art brackets and devices known to applicant are attached either to the exterior surface of the window molding or to the outer surface of a portion of the window per se. All too often, however, the securement of brackets or other devices to the window molding or window for mounting window shades, venetian blinds or mini-blinds to the window results in cracks and/or striations to the window molding and/or window that detract from the aesthetics of the window. Also, prior art brackets and devices for mounting window shades, venetian blinds or mini-blinds tend to require considerable effort and many times do not result in proper alignment of a window shade, venetian blind or mini-blind upon completion of the mounting procedure. Further, the cracks and striations created in the window molding or window due to the exteriorly mounted brackets or devices can become an obvious problem and require filling and painting if a homeowner desires to remove the shade, venetian blind or mini-blind during redecorating or to remove and reposition the shade, venetian blind or mini-blind on a window.

Fortunately, even in view of the shortcomings of prior art efforts known to applicant to address the problem of mounting shades, venetian blinds or mini-blinds to windows without undue effort and damage to the window or window molding, applicant believes that there is a long-felt need for an aesthetically appealing and retractable bracket that can be incorporated into each side of the head jamb of a window to accommodate mounting of window shades, venetian blinds or mini-blinds thereto.

Applicant has met this long-felt need with a retractable bracket that is adapted to be mounted into each opposing side of the head jamb of a window so as to be substantially flush therewith and to be capable of being easily adjusted from a fully retracted position to a selectively extended position when it is desired to mount a shade, curtain, venetian blind or mini-blind to the window. If it is desired to then remove the shade, venetian blind or mini-blind from the window, the bracket at each side of the head jamb of the window can then be easily adjusted so as to be retracted into a substantially flush position with the head jamb upon removal of the shade, venetian blind or mini-blind from each retractable bracket. Furthermore, applicant contemplates that a pair of the retractable brackets of the invention can be provided as an integral part of a window by the window manufacturer, sold as separate units for subsequent attachment to a window during construction of a residence or building or retro-fitted to existing windows.

DISCLOSURE OF THE INVENTION

Thus, in accordance with the present invention, applicant provides a retractable bracket for mounting window blinds, window mini-blinds and window shades to a window having a head jamb at the upper end thereof. The retractable bracket comprises a base adapted for being secured within an aperture defined within the head jamb of the window. A bracket arm defining one or more apertures therein is slidably mounted within the base, and an adjustment means carried by the base serves to operatively engage the bracket arm for selectively moving the bracket arm between a first retracted position within the base to a second extended position extending outwardly from the base. Preferably, in the first retracted position the retractable bracket is substantially flush with the head jamb of the window in which it is mounted.

It is therefore the object of the present invention to provide an aesthetically pleasing and easy-to-use retractable bracket for mounting window shades, venetian blinds and mini-blinds to a window.

It is another object of the present invention to provide an aesthetic and easy-to-use retractable bracket for mounting window shades, venetian blinds and mini-blinds to a window that is vertically adjustable and can be fully retracted when not in use so as to be substantially flush with the head jamb of a window.

It is still another object of the present invention to provide retractable brackets for mounting window shades, venetian blinds and mini-blinds to a window that can be provided as an integral part of a window by the window manufacturer.

It is still another object of the present invention to provide retractable brackets for mounting window shades, venetian blinds and mini-blinds to a window which are adapted to be retro-fitted to the head jamb of a window during or after construction of a residence or building.

Some of the objects of the invention having been stated, other objects will become evident as the description proceeds, when taken in connection with accompanying drawings described in detail below.

BEST MODE FOR CARRYING OUT THE INVENTION

Figure 1B:
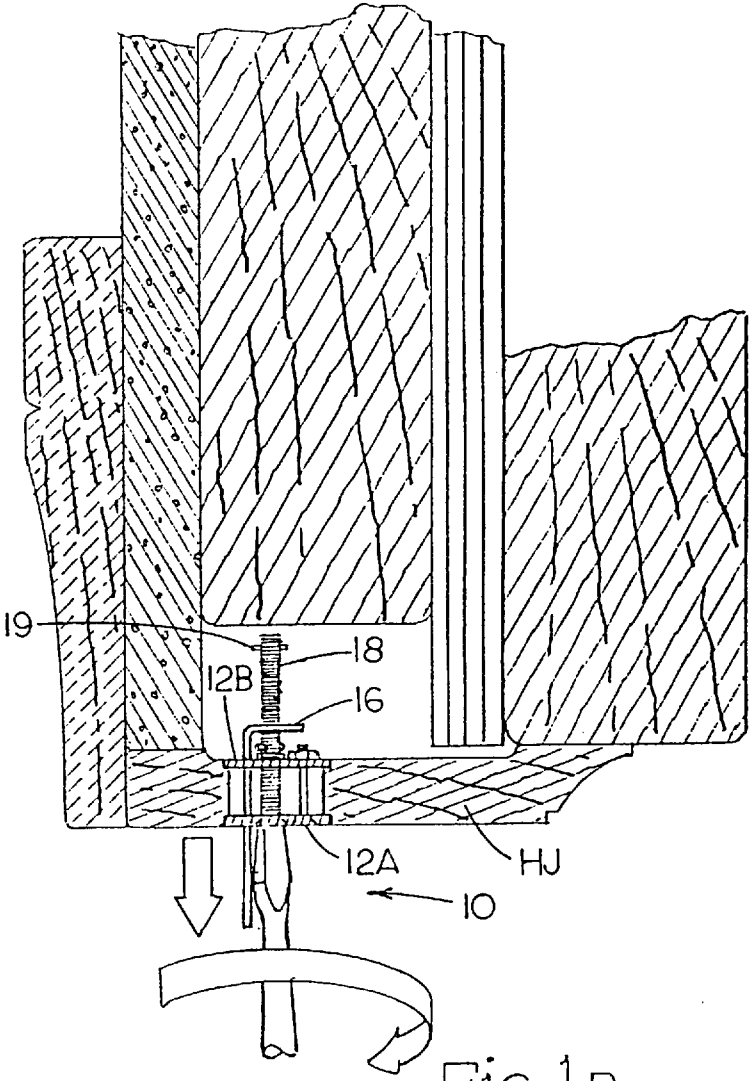
FIG. 1B shows the retractable bracket of FIG. 1A wherein the bracket arm has been adjusted so as to be extended outwardly and downwardly into a position for mounting one end of a window shade, venetian blind or mini-blind thereto.
Figure 1A:
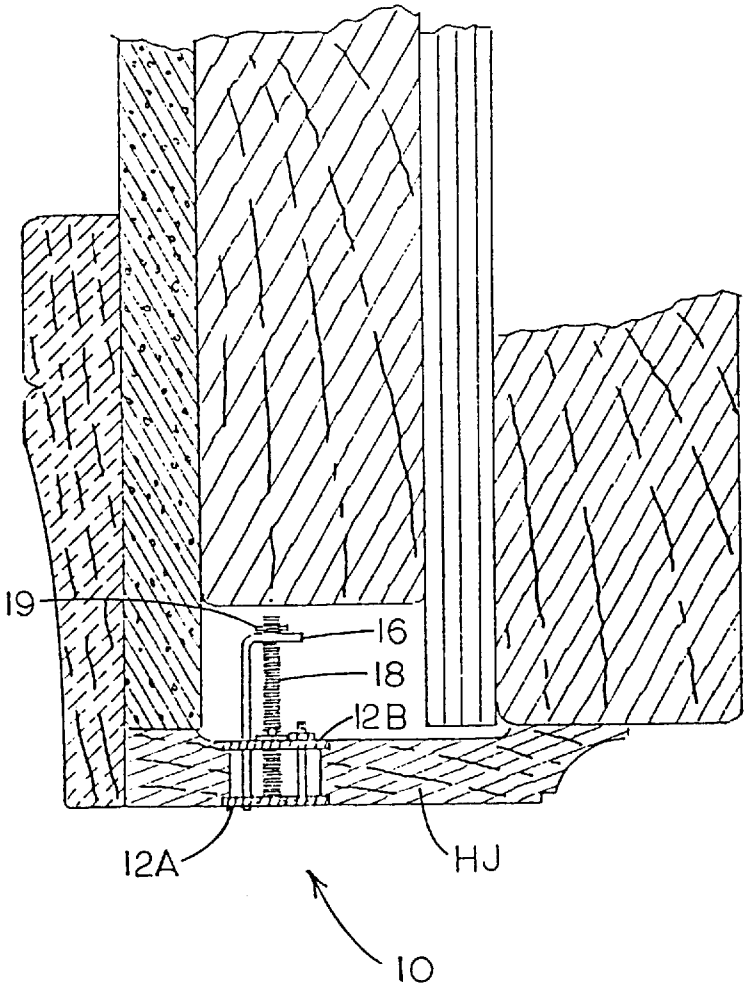
FIG. 1A is a vertical cross-sectional view of the head jamb of a window and the surrounding window frame with the retractable bracket of the invention mounted in the head jamb with the bracket arm thereof substantially retracted.

Referring now more specifically to the drawings, the retractable bracket according to the invention is generally designated 10. A retractable bracket 10 is intended to be mounted in an aperture at each opposing corner of the head jamb HJ of a window (not shown). As noted hereinbefore, retracted bracket 10 as contemplated by the applicant can be provided as an integral part of a window unit as manufactured by a window manufacturer or retractable bracket 10 may be installed in head jamb HJ of a window at the site of installation of a window into a residence or commercial building. Regardless of whether retractable bracket 10 is provided as an integral part of a window by the manufacturer or installed during or after construction of a home or building, a pair of retractable brackets 10 will most suitably be mounted at opposing top corners of head jamb HJ of a window (not shown). If necessary, a suitable space or cavity may have to be provided within a window frame (see, for example, FIGS. 1A and 1B) to accommodate retractable bracket 10.

Figure 2:
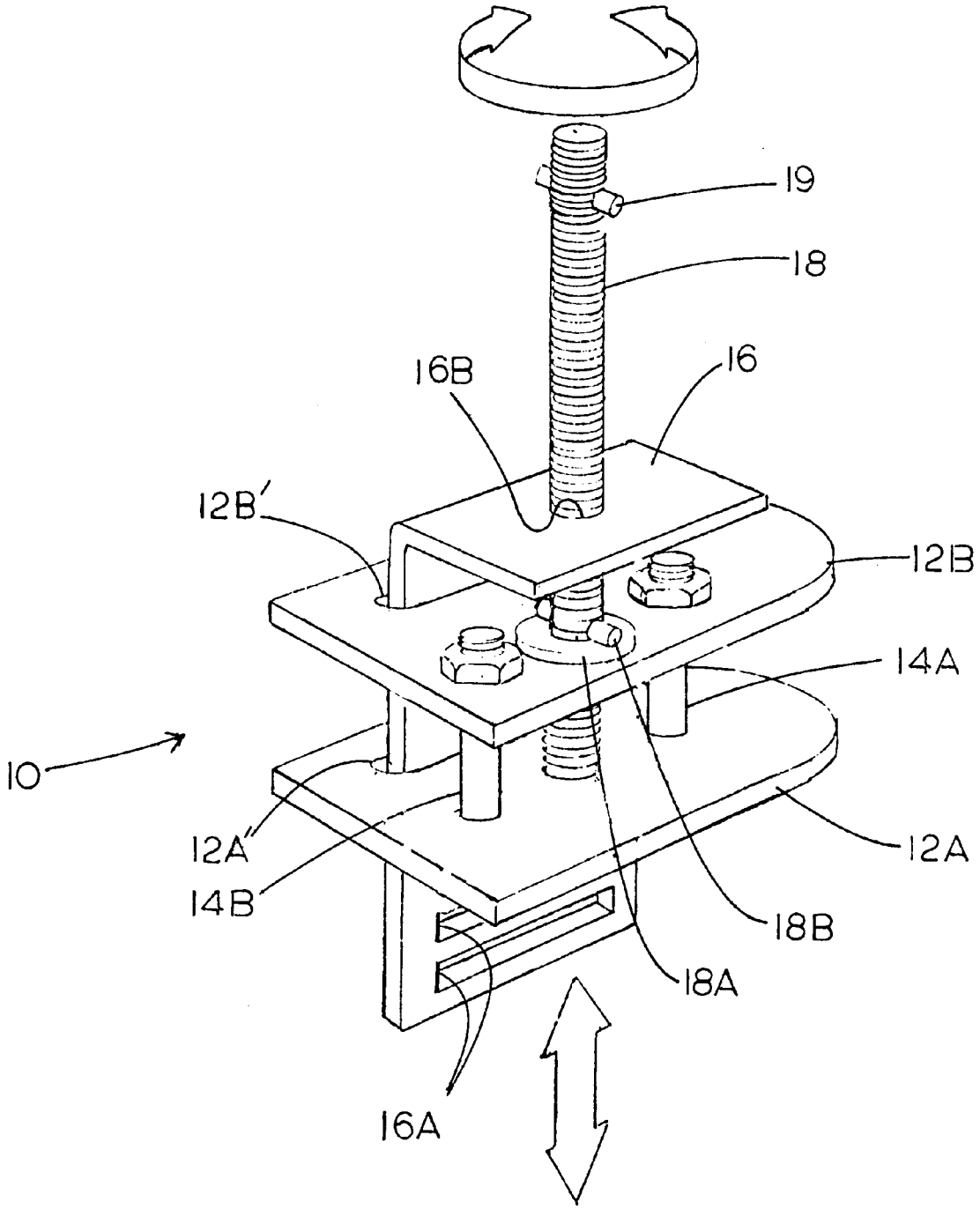
FIG. 2 is a perspective view of the retractable bracket of the invention.
Figure 3:
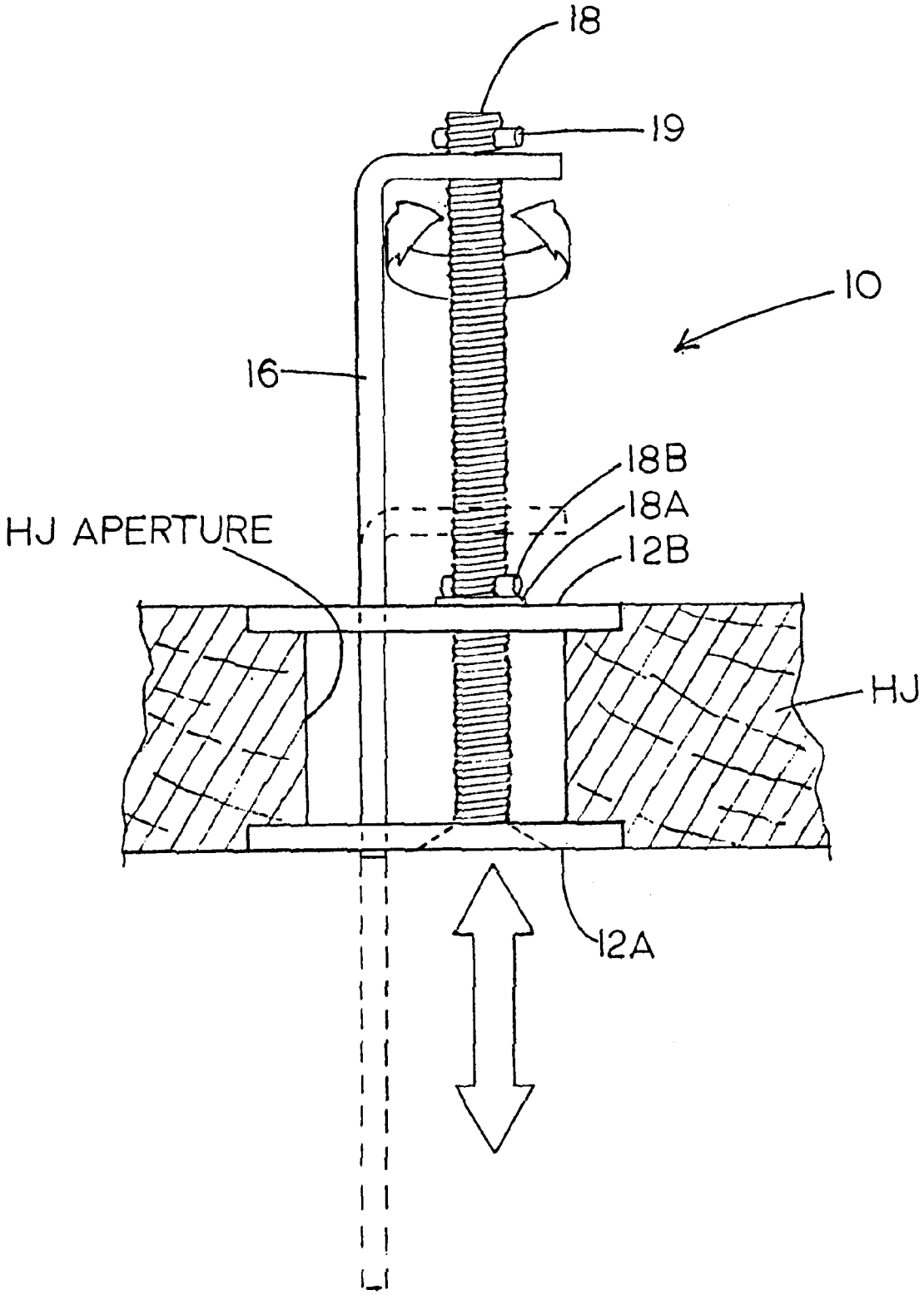
FIG. 3 is a vertical cross-sectional view of the retractable bracket of the invention mounted in the head jamb of a window wherein the substantially retracted position of the bracket arm is shown in solid lines and the extended position is shown in phantom lines.
Figure 4A:
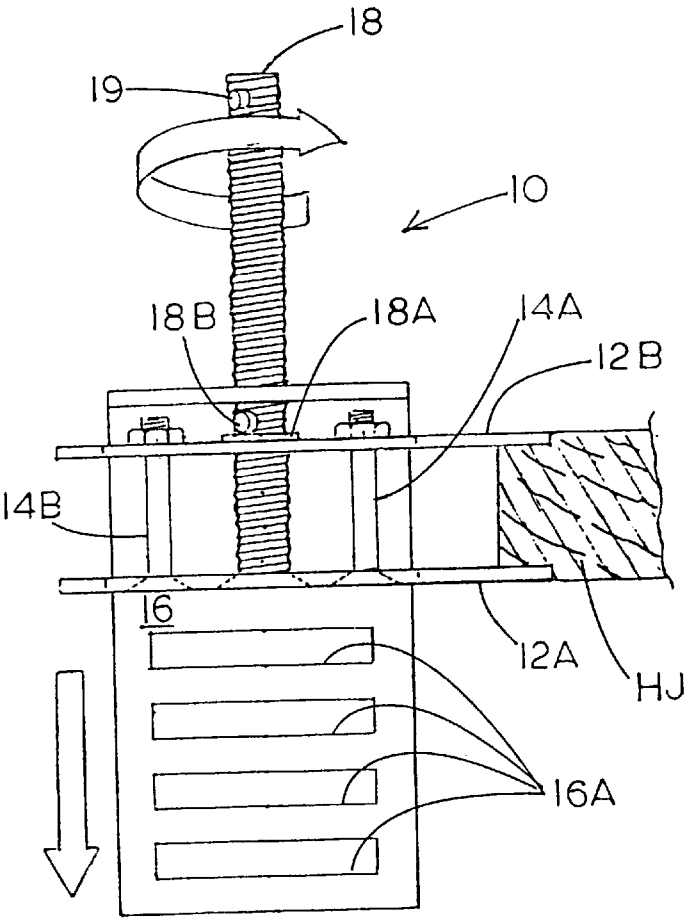
FIG. 4A shows the retractable bracket of FIG. 4 with the bracket arm extended outwardly and downwardly to accommodate mounting of one end of a window shade, venetian blind or mini-blind thereto.
Figure 4:
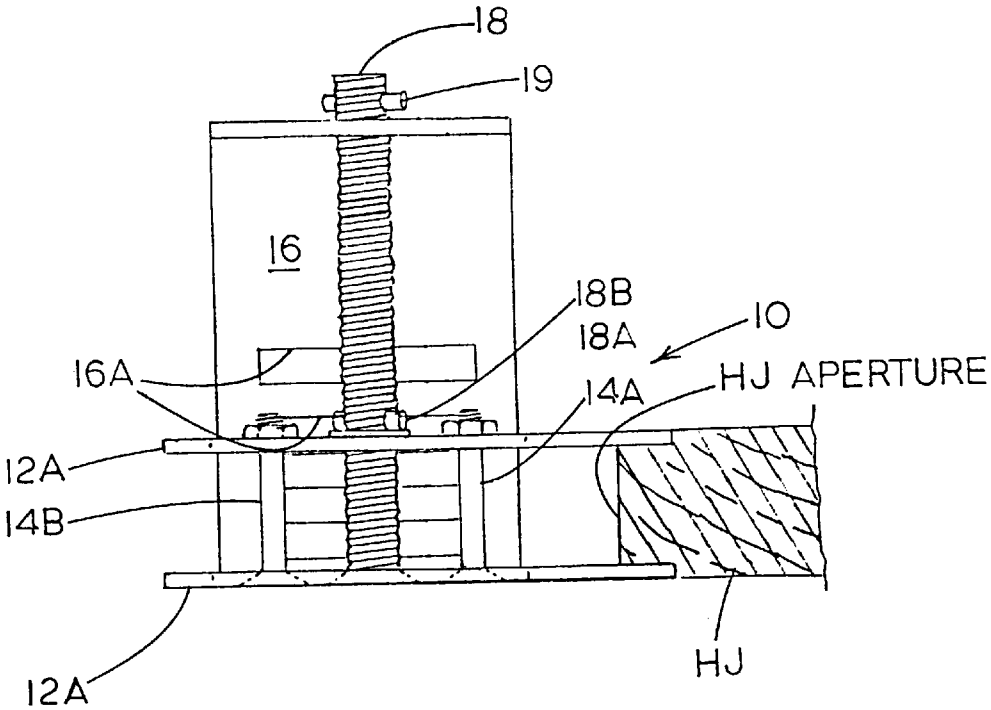
FIG. 4 is a rear elevation view of the retractable bracket of the invention mounted in the head jamb of a window with the bracket arm in its retracted position.

Retractable bracket 10 may be formed and preferably comprises a base formed from lower plate 12A and spaced-apart upper plate 12B that are positioned at the bottom and at the top, respectively, of an aperture in window head jamb HJ (see FIGS. 1A and 1B) and secured together by two screw and nut assemblies 14A and 14B (see FIG. 2 and FIGS. 4 and 4A). An inverted L shaped bracket arm 16 is slidably mounted within retractable bracket 10 so as to be vertically translatable from a first retracted position (see FIGS. 1A, 3 and 4) to a second outwardly and downwardly extended position (see FIGS. 1B, 3 and 4A). Bracket arm 16 is slidably received by an elongate aperture 12A' defined within lower plate 12A and an elongate aperture 12B' defined within upper plate 12B and best seen in FIG. 2 of the drawings. Bracket arm 16 defines a plurality of horizontally extending apertures 16A in spaced-apart relationship for mounting a suitable window shade, venetian blind or mini-blind bracket to one or more selected apertures 16A when bracket arm 16 has been extended outwardly and downwardly into its operative position.

As noted hereinbefore, bracket arm 16 is formed in an inverted L shape so as to define a laterally extending flange portion at the top end thereof that includes a threaded aperture 16B therein. A threaded screw or bolt 18 having a length substantially greater than screw and nut assemblies 14A, 14B extends from lower plate 12A through upper plate 12B and threadingly engages threaded aperture 16B of bracket arm 16 as best seen in FIG. 2 of the drawings. In this fashion, threaded screw 18 can be freely rotated by applying a screwdriver or the like to the head thereof that is rotatably captured by lower plate 12A (see FIGS. 1B and 3) and turning the threaded screw so as to threadingly translate bracket arm 16 vertically upwardly or downwardly into a retracted position or extended position, respectively. For example, applying clockwise rotation to threaded screw 18 with a screwdriver will rotate threaded screw 18 within threaded aperture 16B of bracket arm 16 and urge bracket arm 16 downwardly from a first retracted position (see FIGS. 1A, 3 and 4) to a second downwardly and outwardly extended position (see FIGS. 1B, 2 and 4A). As will be appreciated by one skilled in the art, selective rotation of threaded screw 18 can be accomplished so as to extend bracket arm 16 downwardly to any position between fully retracted and fully extended in order to accommodate a variety of different types of brackets (not shown) for window shades, venetian blinds or mini-blinds that can be attached by conventional means to a selected one or more of apertures 16A defined within bracket arm 16.

Referring again particularly to FIG. 2 of the drawings, applicant wishes to further note that the heads of screws of screw and nut assemblies 14A and 14B are each received within an inverted frusto conically-shaped aperture in lower plate 12A so as to be freely rotatable with a screw driver or the like in order to engage a corresponding related nut of screw and nut assemblies 14A and 14B in order to urge upper plate 12B toward lower plate 12A and thereby secure bracket assembly 10 within an aperture in window head jamb HJ. Similarly, threaded actuator screw 18 is also freely rotatably retained within an inverted frusto conically-shaped aperture within lower plate 12A that retains threaded screw 18 in place while permitting rotation thereof by a screwdriver or the like. Upper plate 12B defines three non-threaded apertures therein for receiving the screws of screw and nut assemblies 14A and 14B and threaded actuator screw 18 therethrough. Most suitably, a washer 18A is provided around threaded screw 18 in contact with the outside surface of upper plate 12B and a locking pin 18B is provided through actuator screw 18 so as to be substantially in contact with the outside surface of washer 18A to stabilize the rotational movement of threaded actuator screw 18 and to prevent threaded screw 18 from falling outwardly from retractable bracket 10. Pin 19 at the top of actuator screw 18 serves to prevent bracket arm 16 from being retracted too far into bracket 10.

Although other materials could be utilized to form retractable bracket 10, applicant contemplates that all elements of retractable bracket 10 should preferably be formed from a rigid material such as steel, aluminum, plastic, or composites. Also, although applicant has shown a preferred embodiment of retractable bracket 10, applicant contemplates that other embodiments of novel retractable bracket 10 can be formed that incorporate applicant's novel inventive concepts and that such other embodiments are intended to be within the scope of the present invention.

In use, a pair of retractable brackets 10 would normally be provided by the manufacturer or retrofitted at a construction site to two spaced-apart apertures in the top opposing corners of a window head jamb HJ board. When a residential or commercial building is completed that incorporates one or more windows having a pair of retractable brackets 10 located in the top corners of the head jamb HJ, the occupant would most suitably find each of retractable brackets 10 in its fully retracted position so as to be substantially flush with head jamb HJ in order to present an aesthetically pleasing appearance to the window. If it is desired to attach a window shade, venetian blind or mini-blind to a window having a pair of retractable brackets 10 mounted in the head jamb HJ thereof, the occupant would only be required to obtain a screwdriver and selectively turn threaded actuator screw 18 in order to urge bracket arm 16 outwardly and downwardly from lower plate 12A of retractable bracket 10. Most suitably, each retractable bracket 10 at opposing corners of head jamb HJ would be adjusted by a screwdriver so that bracket arms 16 are at substantially equal downwardly and outwardly extended positions. Then, the occupant of the residence or commercial building would secure a suitable bracket for a window shade, venetian blind or window blind to one or more selected apertures 16A in the bracket arm 16 of each spaced-apart retractable bracket 10 in the head jamb RJ of the window. Thereafter, the occupant would conventionally secure the window shade, venetian blind or mini-blind to the brackets that have been secured to the extended bracket arm 16 of the pair of retractable brackets 10 mounted within head jamb HJ of a window.

In this fashion, a pair of retractable brackets 10 mounted in head jamb HJ at opposing upper corners of a window will serve to support a window shade, venetian blind or mini-blind in a window. Also, since a pair of retractable brackets 10 mounted in head jamb HJ at opposing upper corners of a window are mounted so as to be flush with the outside surface head jamb HJ, the pair of retractable brackets 10 should be in proper relative vertical alignment to each other so as to facilitate easy and proper alignment of a window shade, venetian blind or mini-blind secured to bracket arm 16 of each of a respective pair of retractable brackets 10. However, if a minor adjustment should be necessary to the alignment of a window shade, venetian blind or mini-blind, the infinite vertical adjustability of each retractable bracket 10 makes such an adjustment easy to accomplish.

If an occupant wishes to remove a window shade, venetian blind or mini-blind mounted to a pair of retractable brackets 10, the window shade, venetian blind or mini-blind and associated brackets can be easily removed from retractable brackets 10 and retractable brackets 10 then adjusted by applying a screwdriver to each threaded actuator screw 18 in order to rotatably urge each bracket arm 16 inwardly to its fully retracted and substantially flush position with lower plate 12A of retractable brackets 10 (and the outside surface of window head jamb HJ). In this fashion, removal of a window shade, venetian blind or window blind from a window does not result in damage to the window or window molding in the form of cracks and/or striations as is typically the case with prior art mounting brackets. Moreover, retractable brackets 10 remain in place and ready to be used again if the occupant of a residence or building decides at a later date to again mount a window shade, venetian blind or mini-blind to the window.

It will be understood that various details of the invention may be changed without departing from the scope of the invention. Furthermore, the foregoing description is for the purpose of illustration only, and not for the purpose of limitation—the invention being defined by the claims.

What is claimed is:

1. A retractable bracket assembly for mounting window blinds or shades to a window having a head jamb at the upper end thereof, and said retractable bracket comprising:

(a) a head jamb of a window having an aperture therethrough;

(b) a base adapted for being secured within the aperture defined within the head jamb of the window;

(c) a bracket arm defining one or more window blind mounting apertures therein and being slidably mounted within said base for movement between a first retracted position within said base and said head jamb to a second extended position extending outwardly from said base and said head jamb; and (d) adjustment means carried by said base and operatively engaging said bracket arm for selectively moving said bracket arm between said first retracted position within said base to said second extended position extending outwardly from said base.

2. The retractable bracket according to claim 1 wherein said bracket arm comprises an elongate plate defining a first end and a second end and defining a plurality of spaced-apart window blind mounting apertures along at least a portion of the length thereof between said first and second ends.

3. The retractable bracket according to claim 1 wherein said adjustment means comprises a screw that is rotatably mounted at one end within said base and that threadingly engages said bracket arm at the other end thereof for moving said bracket arm between the first and second positions.

4. A retractable bracket assembly for mounting window blinds and shades to a window having a head jamb at the upper end thereof, and said retractable bracket comprising:

(a) a head jamb of a window having an aperture therethrough;

(b) a base adapted for being secured within the aperture defined within the head jamb of the window;

(c) a bracket arm defining one or more window blind mounting apertures therein and being slidably mounted within said base and said head jamb; and (d) adjustment means carried by said base and operatively engaging said bracket arm for selectively moving said bracket arm between a first retracted position within said base and said head jamb to a second extended position extending outward from said base and said head jamb, wherein said bracket arm comprises an elongate plate defining a first end and a second end and defining a plurality of spaced-apart window blind mounting apertures along at least a portion of the length thereof between said first and second end, and wherein said elongate plate defines an inverted L shape wherein said first end comprises a flange extending outwardly therefrom that is operatively engaged by said adjustment means and moves within said retractable bracket as said bracket arm moves from the first retracted position to the second extended position, and said second end correspondingly moves outwardly from said base as said bracket arm moves from the first retracted position to the second extended position.

5. In combination:

(a) a window having a head jamb at the upper end thereof with an aperture formed therethrough; and (b) a retractable bracket for mounting window blinds or shades to the window positioned in said aperture of said head jamb, said retractable bracket comprising:

(i) a base secured within said aperture formed within the head jamb of the window;

(ii) a bracket arm defining one or more window blind mounting apertures therein and being slidably mounted within said base for movement between a first retracted position within said base and said head jamb to a second extended position extending outwardly from said base and said head jamb; and (iii) adjustment means carried by said base and operatively engaging said bracket arm for selectively moving said bracket arm between said first retracted position within said base and said head jamb to said second extended position extending outwardly from said base and said head jamb.

6. The combination according to claim 5 wherein said bracket arm of said retractable bracket comprises an elongate plate defining a first end and a second end and defining a plurality of spaced-apart blind mounting apertures along at least a portion of the length thereof between said first and second ends.

7. The combination according to claim 5 wherein said adjustment means of said retractable bracket comprises a screw that is rotatably mounted at one end within said base and that threadingly engages said bracket arm at the other end thereof for moving said bracket arm between the first and second positions.

8. The combination according to claim 6 including a mini-blind bracket removably secured to each of said two retractable brackets.

9. In combination:

(a) a window having a head jamb at the upper end thereof with an aperture formed therethrough; and (b) a retractable bracket for mounting window blinds and shades to the window positioned in said aperture of said head jamb, said retractable bracket comprising:

(i) a base secured within said aperture formed within the head jamb of the window;

(ii) a bracket arm defining one or more window blind mounting apertures therein and being slidably mounted within said base and said head jamb wherein said bracket arm of said retractable bracket comprises an elongate plate defining a first end and a second end and defining a plurality of spaced-apart blind mounting apertures along at least a portion of the length thereof between said first and second ends; and (iii) adjustment means carried by said base and operatively engaging said bracket arm for selectively moving said bracket arm between a first retracted position within said base and said head jamb to a second extended position extending outwardly from said base and said head jamb;

wherein said elongate plate defines an inverted L shape wherein said first end comprises a flange extending outwardly therefrom that is operatively engaged by said adjustment means and moves within said retractable bracket as said bracket arm moves from the first retracted position to the second extended position, and said second end correspondingly moves outwardly from said base as said bracket arm moves from the first retracted position to the second extended position.

10. A retractable bracket for mounting window blinds or shades to a window having a head jamb at the upper end thereof, and said retractable bracket comprising:

(a) a base adapted for being secured within an aperture defined within the head jamb of a window molding, said base comprising two spaced-apart plates secured together by at least one screw extending therebetween;

(b) a bracket arm defining one or more window blind mounting apertures therein and being slidably mounted within said base for movement between a first retracted position within said base to a second extended position extending outwardly from said base; and (c) adjustment means carried by said base and operatively engaging said bracket arm for selectively moving said bracket arm between said first retracted position within said base to said second extended position extending outwardly from said base.

11. In combination:

(a) a window having a head jamb at the upper end thereof; and (b) at least one retractable bracket for mounting window blinds or shades to the window, said retractable bracket comprising:

(i) a base secured within an aperture defined within the head jamb of the window, said base of said retractable bracket comprising two spaced-apart plates secured together by at least one screw extending therebetween;

(ii) a bracket arm defining one or more window blind mounting apertures therein and being slidably mounted within said base for movement between a first retracted position within said base to a second extended position extending outwardly from said base; and (iii) adjustment means carried by said base and operatively engaging said bracket arm for selectively moving said bracket arm between said first retracted position within said base to said second extended position extending outwardly from said base.

* * * * *